US012364917B1

(12) United States Patent
Margareten

(10) Patent No.: US 12,364,917 B1
(45) Date of Patent: Jul. 22, 2025

(54) ELECTRONIC CORNHOLE GAME BOARD WITH AUTOMATIC SCORING

(71) Applicant: Dime Trading Corp., Brooklyn, NY (US)

(72) Inventor: Isamar Margareten, Brooklyn, NY (US)

(73) Assignee: Dime Trading Corp., Brooklyn, NY (US)

( * ) Notice: Subject to any disclaimer, the term of this patent is extended or adjusted under 35 U.S.C. 154(b) by 0 days.

(21) Appl. No.: 19/088,347

(22) Filed: Mar. 24, 2025

Related U.S. Application Data

(63) Continuation-in-part of application No. 18/922,049, filed on Oct. 21, 2024.

(51) Int. Cl.
*A63B 71/06* (2006.01)
*A63B 67/06* (2006.01)

(52) U.S. Cl.
CPC ..... *A63B 71/0669* (2013.01); *A63B 67/06* (2013.01); *A63B 2071/0625* (2013.01); *A63B 2071/0694* (2013.01); *A63B 2225/50* (2013.01); *A63B 2225/74* (2020.08)

(58) Field of Classification Search
CPC ..... A63B 71/0669; A63B 67/06; A63B 2071/0625; A63B 2071/0694; A63B 2225/50; A63B 2225/74
USPC ..... 273/402; 700/92
See application file for complete search history.

(56) References Cited

U.S. PATENT DOCUMENTS

| | | | | |
|---|---|---|---|---|
| 5,839,976 | A * | 11/1998 | Darr | A63B 5/22 273/237 |
| 5,863,045 | A * | 1/1999 | Watson | A63B 67/06 273/377 |
| 11,331,550 | B1 * | 5/2022 | Showalter | A63B 71/0669 |
| 11,648,453 | B2 * | 5/2023 | Michael | A63B 67/06 273/372 |
| 12,115,426 | B1 * | 10/2024 | Person | G16Y 40/35 |
| 2022/0096909 | A1 * | 3/2022 | Russell | H05B 47/19 |

OTHER PUBLICATIONS

Automated Cornhole Scoring System, uploaded by ECE Department on Apr. 22, 2014 at https://www.youtube.com/watch?v=AZAraY28n6E (Year: 2014).*

(Continued)

*Primary Examiner* — Michael D Dennis
(74) *Attorney, Agent, or Firm* — Thorpe North & Western, LLP.

(57) ABSTRACT

A cornhole game board comprises a platform with an aperture and a display to display a score. An aperture sensor is positioned proximate to the aperture to sense a beanbag passing through the aperture. A platform sensor is coupled to the platform to sense a beanbag impacting the platform. An indicator light is carried by the platform to indicate a team turn. Processors send a signal to the indicator light to enable an indication of the team turn; receive a signal from the aperture sensor indicating a hole score for the team turn; receive a signal from the platform sensor indicating a board score for the team; determine a team score based on signals from the aperture sensor and the platform sensor and the team turn; and send a signal to the display to enable display of the team score.

20 Claims, 8 Drawing Sheets

(56) References Cited

OTHER PUBLICATIONS

Automated Cornhole, uploaded by Charbareg61 on Apr. 22, 2012 at https://www.youtube.com/watch?v=Ha2elzjqnEg (Year: 2012).*
Automated Cornhole Scoring System, uploaded by Wyatt Abbott on Apr. 27, 2021 at https://www.youtube.com/watch?v=qmt_Hap7kVc&t=500s; (Year: 2021).*
Automatic Scoring Systems for Cornhole, published by Musch et al. on Jun. 3, 2024 at https://ucteam12.github.io, retrieved on May 14, 2025 from https://web.archive.org/web/20240603200326/https://ucteam13.github.io/ (Year: 2025).*

* cited by examiner

ELECTRONIC CORNHOLE GAME BOARD WITH AUTOMATIC SCORING

PRIORITY CLAIM AND RELATED APPLICATIONS

This is a continuation-in-part of U.S. patent application Ser. No. 18/922,049, filed Oct. 21, 2024, which is hereby incorporated herein by reference.

BACKGROUND OF THE INVENTION

1. Field of the Invention

This invention relates to an electronic cornhole game; and more particularly relates to a cornhole game board that has an electronic scoring and display system.

2. Description of the Related Art

Cornhole is a popular game and competitive sport that is typically played on relatively large wooden board structures with hole. Individuals or teams compete by throwing beanbags towards the hole. Points are scored by getting beanbags through the hole and strategies can be employed by landing beanbags on the board in front of the hole to block subsequent beanbags from sliding on the board and into the hole.

The large, wooden boards are heavy and can be difficult to transport. In addition, in friendly play it can be easy to lose track of the score. The improvement of cornhole is an on-going endeavor.

BRIEF DESCRIPTIONS OF THE DRAWINGS

With the above and other related objectives in view, the invention consists in the details of construction and combination of parts, as will be more fully understood from the following description, when read in conjunction with the accompanying drawings in which.

DETAILED DESCRIPTION OF THE EMBODIMENTS OF THE INVENTION

Illustrative embodiments of the present invention are described below. The following explanation provides specific details for a thorough understanding of and enabling description for these embodiments. One skilled in the art will understand that the invention may be practiced without such details. In some instances, well-known structures, processes, and functions have not been shown or described in detail to avoid unnecessarily obscuring the description of the embodiments.

It shall be noted that unless the context clearly requires otherwise, throughout the description, the words "comprise," "comprising," "include," "including," and the like are to be construed in an inclusive sense as opposed to an exclusive or exhaustive sense; that is to say, in the sense of "including, but not limited to." Words using the singular or plural number also include the plural or singular number, respectively while adhering to the concepts of the present invention. Furthermore, references to "one embodiment" and "an embodiment" are not intended to be interpreted as excluding the existence of additional embodiments that also incorporate the recited features.

An electronic cornhole game board is provided to enable one or more players to play a cornhole game by tossing beanbags towards a hole in the game board. The game board can automatically and electronical detect a score and display the score. For example, the game board can have infrared scoring sensors in which infrared sensors in the hole detect bags passing through, e.g. for three points. In addition, the game board can have vibration scoring sensors in which vibration sensors of the game board detect when a bag lands, e.g. for one point. The game board can have near-field communication sensors to determine an approximate location of a bag on the game board. The game board can have a light emitting diode (LED) scoreboard to display the score. The game board can light to indicate a turn of a player or a team. The game board can have dynamic LED strips in which red/green/blue (RGB) LED strips change colors according to the game, e.g. with red displayed for a red team and blue displayed for a blue team. In one aspect, the game board can have a foldable and portable design in which the game board folds in half for compact storage and transportation.

The game board can have a persistent score memory in which scores are retained for a number of rounds, as long as the power remains on. The game board can have inter-board communication in which two game boards communicate with each other and a remote control via Bluetooth or WiFi. The game board can have celebratory lighting in which all RGB colors light up when a winner is declared and when the system powers on. The game board can have a built-in carry handle for effortless mobility. The beanbags may be compliant bags filled with dried beans or beads.

Figure 1:
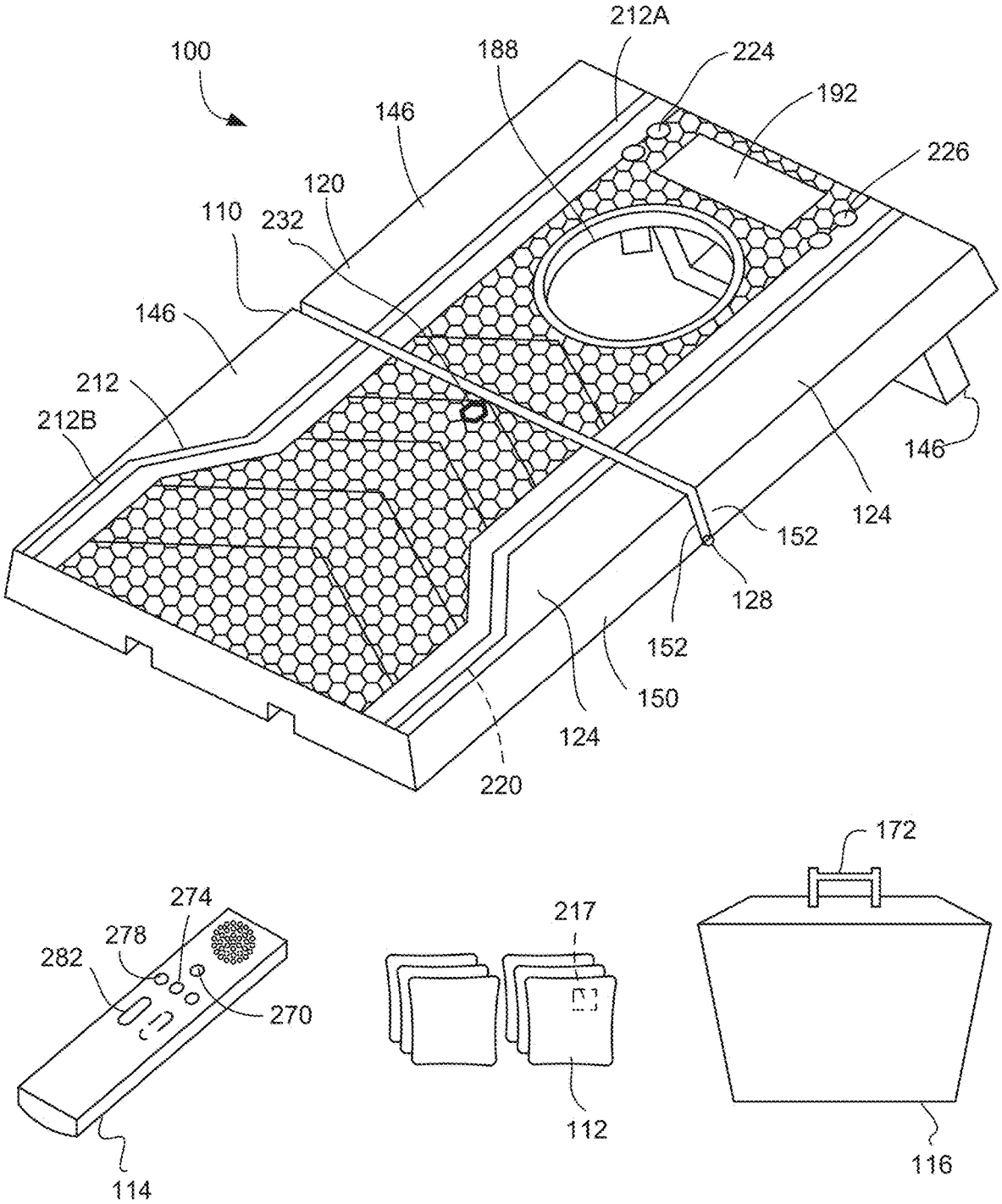
FIG. 1 is a schematic perspective view of an example cornhole game system in accordance with an embodiment of the present invention.

Referring to FIG. 1, a cornhole game system 100 is shown in accordance with an example of the invention. The system 100 can include a cornhole game board 110, beanbags 112 (e.g. a first set of a first color and second set of a second color), and a remote control 114. The game board 110 can be configured to be placed upon a support surface, such as the ground or a floor. In one aspect, the system 100 can further comprise a storage bag 116 to store and removably contain the game board 110, the beanbags 112 and the remote control 114. The game board 110 can be an electronic foldable game board as described herein.

Figure 2:
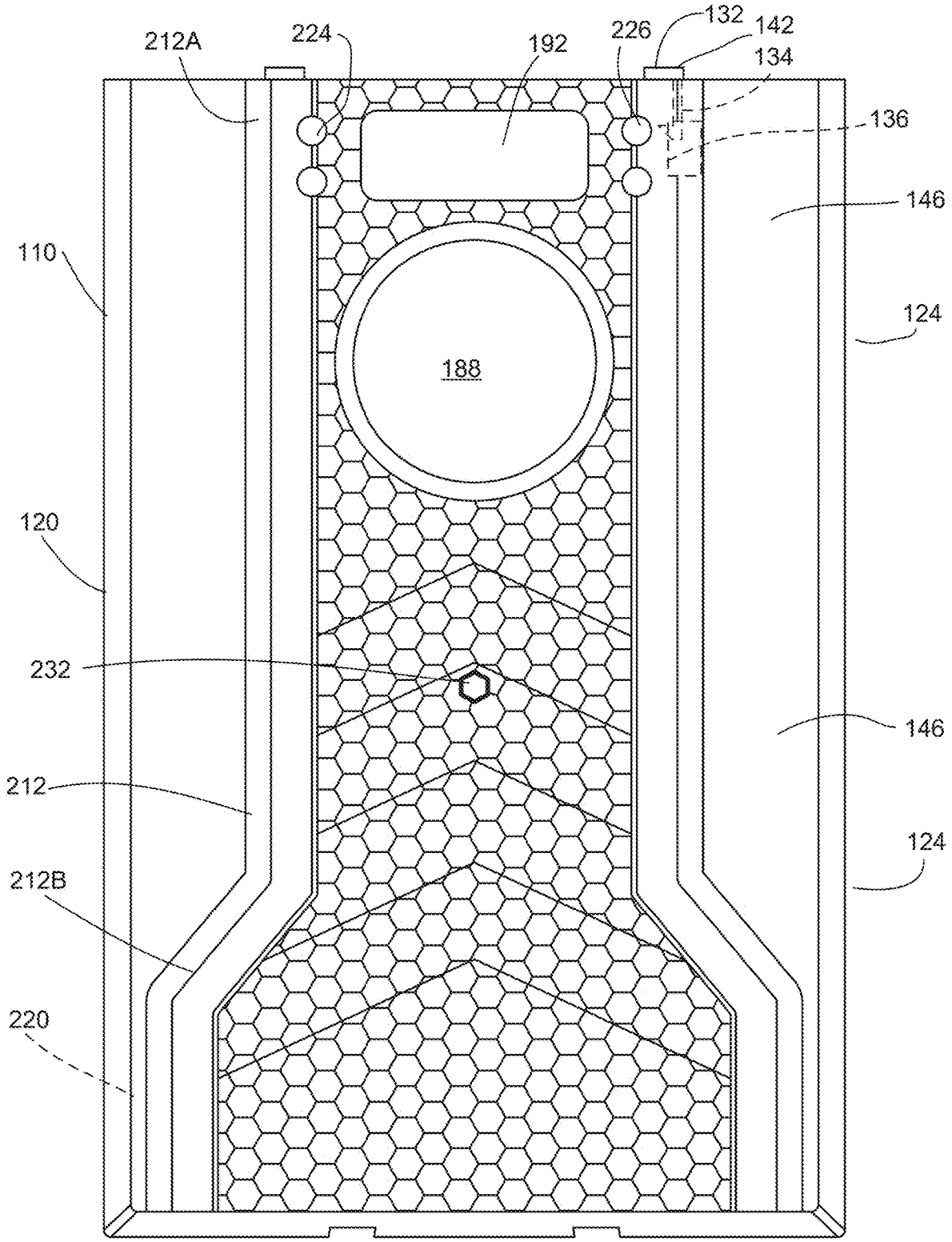
FIG. 2 is a top view of an example cornhole game board of the cornhole game system of FIG. 1 in accordance with an embodiment of the present invention.
Figure 3:
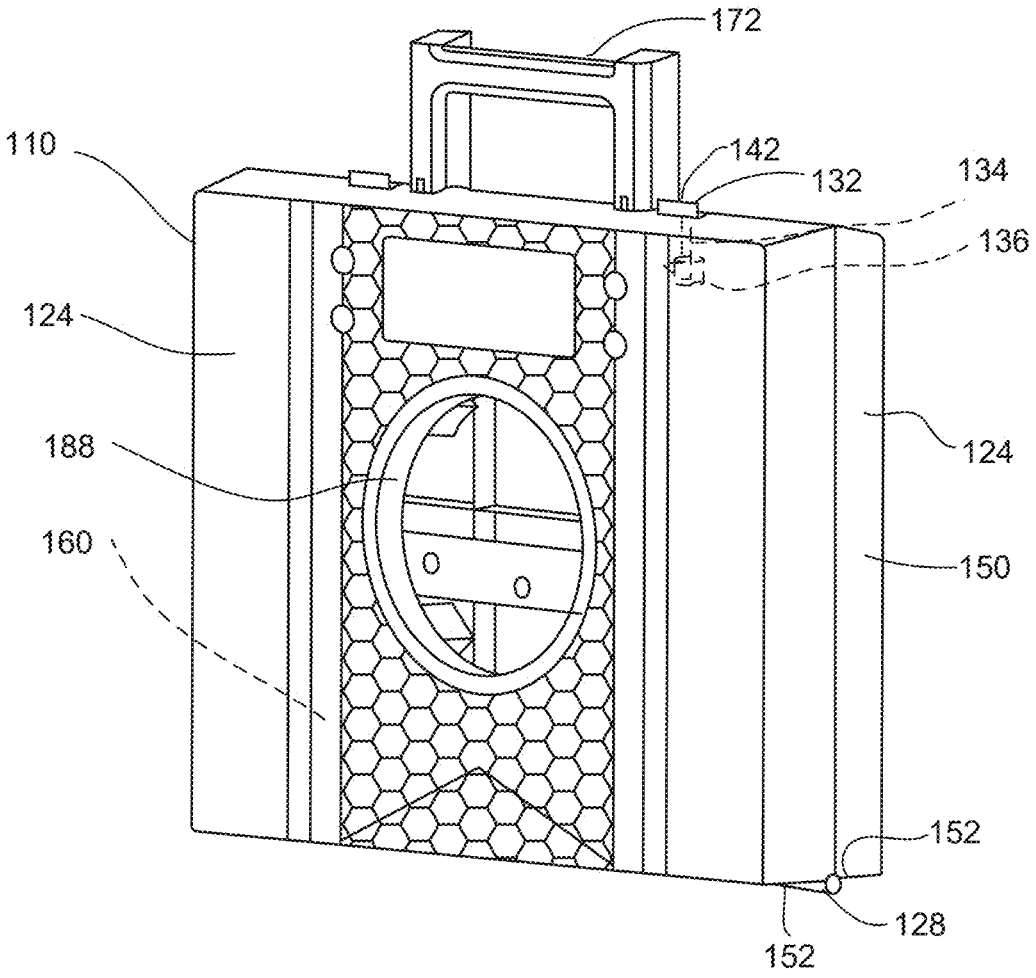
FIG. 3 is a perspective view of the cornhole game board of FIG. 2, shown in a closed storage orientation.
Figure 4:
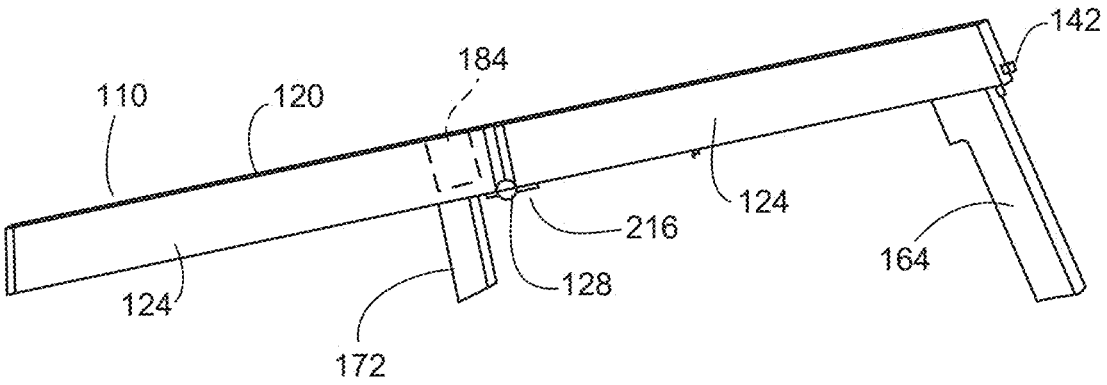
FIG. 4 is a side view of the cornhole game board of FIG. 2, shown in an open play orientation.

Referring to FIGS. 1-7, the game board 110 can comprise a platform 120 that can be inclined to form an inclined platform. In one embodiment, the inclined platform 120 can be formed by a pair of panels 124 pivotally coupled together at a hinge 128. The panels 124 can fold about the hinge 128 between: 1) an open play orientation, as shown in FIGS. 1, 2 and 4, and 2) a closed storage orientation, as shown in FIG. 3. In the open play orientation, the pair of panels 124 can be folded apart from one another to form the inclined platform 120. In the closed storage orientation, the pair of panels 124 can be folded together.

In one aspect, the panels 124 can have a slide lock 132 located opposite the hinge 128 (in the closed storage orientation) to hold the panels 124 together in the closed storage orientation. The slide lock 132 can have a hook 134 that extends from one panel and into engagement with a lock hole 136 in the other panel. The slide lock 132 can slide laterally and be biased in a locked position, such as by a spring. The hook 134 can have an inclined leading edge that abuts to an edge of the lock hole 136 during closing to displace the hook 134 laterally away from the locked position. When the panels 124 are closed together, the hook 134 can clear the edge and the spring can bias the hook 134 back to the locked position with an interior blunt edge of the hook 134 engaging an inner edge of the lock hole 136. To unlock, a user can engage a finger tab 142 extending from the hook 134 to an exterior of the panels 124 to slide the hook 134 from the locked position to an unlocked position and to allow the panels 124 to be separated. In one aspect, the slide lock 132 can comprise a pair of slide locks spaced-apart from one another.

In another aspect, the panels 124 can have front surfaces 146 that form the inclined platform 120. In addition, the panels 124 can have a perimeter wall 150 that extends rearward from the front surface 146 to form shells. The perimeter wall 150 can provide strength and rigidity to the front surface 146. In addition, the perimeter wall 150 can have a thickness. The panels 124 or shells can have proximate segments 152 of the perimeter wall that abut to one another in the open play orientation to limit the hinge 128 and the angular orientation between the panels 124 to maintain a flat plane of the front surfaces 146 when combined to form the inclined platform 120. The shells of the panels 124 can have a cavity 156 that forms a substantially enclosed interior 160 in the closed storage orientation that can contain the beanbags 112. The panels 124 can be formed of plastic and can be formed by injection molding.

A rear leg 164 can be pivotally coupled to a rear of the inclined platform 120 and to one of the pair of panels 124. The rear leg 164 can be pivotal between an extended position extending from the inclined platform 120 and the pair of panels 124, and a retracted position against the inclined platform 120 and one of the pair of panels 124. The rear leg 164 can elevate a rear of the inclined platform 120 and the pair of panels 124 in the extended position to incline the platform 120 and the panels 124 with respect to the support surface (e.g. the ground or a floor). The rear leg 164 can have a proximal end pivotally secured to the inclined platform 120 and one of the pair of panels 124, and a distal spar 168 configured to abut to the support surface when the rear leg 164 is in an extended position.

Figure 5:
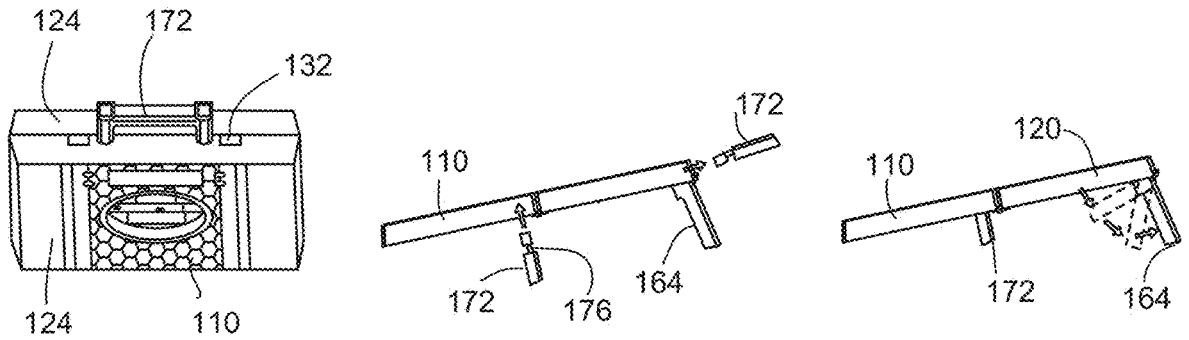
FIG. 5 is a schematic side view of the cornhole game board of FIG. 2, shown transitioning from the closed storage orientation to the open play orientation.
Figure 6:
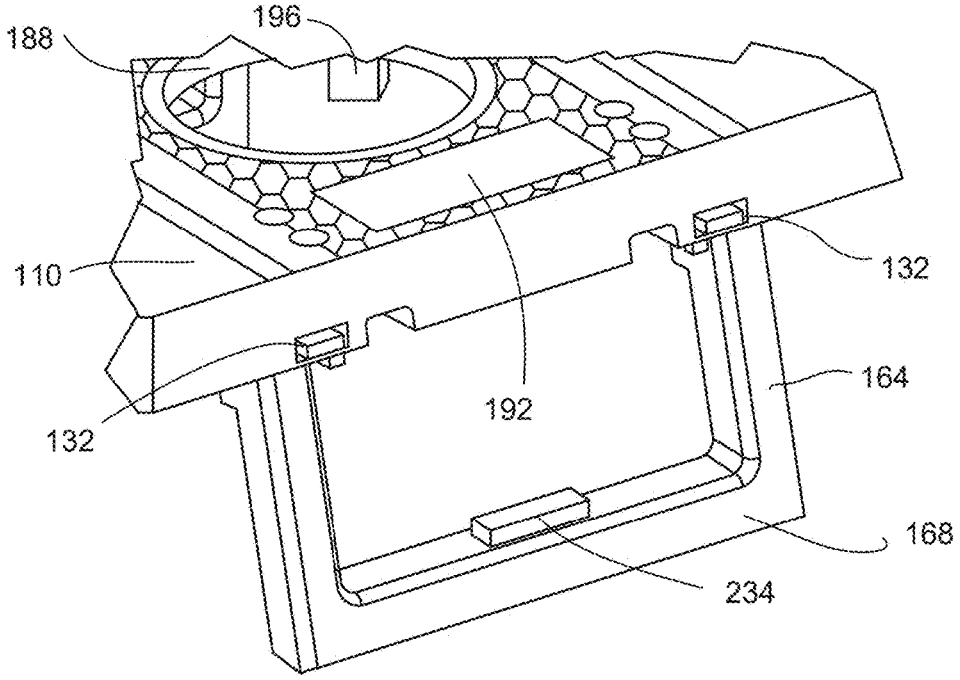
FIG. 6 is a partial rear perspective view of the cornhole game board of FIG. 2.

In some embodiments, the game board 110 can have a U-shaped member 172 selectively coupled to the pair of panels 124 in one of two different positions, including a handle position (FIGS. 1 and 3) and a leg position (FIGS. 4 and 5). In the handle position, the U-shaped member 172 can extend from the pair of panels 124 in the closed storage orientation to enable carrying the pair of panels 124 by the U-shaped member 172, as shown in FIG. 3. In the leg position, the U-shaped member 172 can extend from an intermediate location of the inclined platform 120 and the panels 124 in the open play orientation to enable support of the intermediate location of the inclined platform 120 and the panels 124 by the U-shaped member 172, as shown in FIG. 4. The U-shaped member 172 can transition from the handle position to the leg position, as shown in FIG. 5, and back to the handle position.

In one aspect, the U-shaped member 172 can have distal ends with a narrow neck 176 (FIG. 5) that can be captured and retained in apertures 180 (FIG. 7) between the pair of panels 124 in the closed storage orientation. The distal ends of the U-shaped member 172 can be received in sockets 184 in one of the panels 124 proximate to the hinge 128 in the open play orientation.

An aperture 188 can be formed in the inclined platform 120 and one of the pair of panels 124. The aperture 188 can be sized and shaped to receive one or more beanbags 112 therethrough. The aperture 188 can be positioned towards the rear or far end of the inclined platform 120.

A display 192 can be carried by the game board 110, the inclined platform 120 and one of the pair of panels 124. The display 192 can be configured to display at least one score. In one aspect, the display 192 can be a dual display configured to display two team scores in different colors. In another aspect, the display 192 can be an LED display. In another aspect, the display 192 can be positioned above the aperture 188 and between the aperture 188 and the rear or far end of the inclined platform 120. Thus, the display 192 can be positioned where it is least likely to be impacted and/or covered by a beanbag 112. In another aspect, an upper surface of the display 192 can be flush with, or coplanar with, the front surface 146 of the panels 124 and the inclined platform 120 so as to resist interference with game play.

An aperture sensor 196 can be positioned proximate to the aperture 188 and configured to sense a beanbag 112 passing through the aperture 188. In one aspect, the aperture sensor 196 can be located under the inclined platform 120 and the panel 124, and in the cavity 156 of the panel 124. The aperture sensor 196 can be an infrared sensor and can include an IR source 200 on one side of the aperture 188 and directed towards the IR sensor 196 on an opposite side and opposing the IR source 200. The IR source 200 can direct an IR beam 204 across the aperture 188 that can be interrupted by a beanbag 112, and which interruption can be sensed or detected by the IR sensor 196. In another aspect, the IR sensor 196 can comprise a plurality of IR sensors. In another aspect, the aperture sensor 196 can comprise one or more radio frequency identification (RFID) sensors, magnetic field sensors, etc.

A platform sensor 208 can be coupled to the inclined platform 120 and the pair of panels 124. The platform sensor 208 can be configured to sense a beanbag 112 impacting the inclined platform 120 or the panels 124. In one aspect, the platform sensor 208 can be located under the inclined platform 120 and the panels 124, and in the cavity 156 of the panel 124. In another aspect, the platform sensor 208 can comprise a plurality of platform sensors spread out across the inclined platform 120 and the panels 124. In another aspect, the platform sensor 208 can comprise one or more vibration sensors, radio frequency identification (RFID) sensors, weight sensors, gyroscope sensors, accelerometers, magnetic field sensors, etc.

An indicator light 212 can be carried by the inclined platform 120 and one of the pair of panels 124. The indicator light 212 can be configured to indicate a team turn. In one aspect, the indicator light 212 can be configured to alternately indicate one of two team turns. Thus, the indicator light 212 configured to emit two different colors including a first color corresponding to a first team and a second color corresponding to a second team. For example, the indicator light 212 can alternately indicate a first color (e.g. red) associated with a first player or team, and a second color (e.g. blue) associated with a second player or team. In another aspect, the indicator light 212 can be a multi-colored LED light.

The beanbags 112 can have two different colors matching the first and second colors indicated by the indicator light 212. The system 100 can comprise two sets of beanbags 112 including a first set of beanbags with the first color corresponding to the first team and a second set of beanbags with the second color corresponding to the second team.

In some embodiments, the indicator light 212 can comprise an indicator light strip extending across the inclined platform 120 and across the pair of panels 124. In one aspect, the indicator light strip can extend from the rear edge of the inclined platform 120 to the front edge of the inclined platform 120. Thus, the indicator light strip can facilitate visibility for a user positioned at a distance from the game board 110. In another aspect, the indicator light 212 and the indicator light strip can comprise a first segment 212A carried by a first panel of the pair of panels 124 and a second segment 212B electrically coupled to the first segment 212A and carried by a second panel of the pair of panels 124. Thus, the indicator light 212 and the indicator light strip can transverse the inclined platform 120 and be discontinuous to accommodate the foldable panels 124. A flexible electrical connector 216 (FIG. 4) can extend across the hinge 128 and interconnect the first and second segments 212A and 212B.

In one aspect, the indicator light 212 or the indicator light strip can comprise a plurality of indicator lights or indicator light strips. In another aspect, an upper surface of the indicator light 212 or the indicator light strip can be flush with, or coplanar with, the front surface 146 of the panels 124 and the inclined platform 120 so as to resist interference with the beanbags 112 and game play.

In another aspect, the indicator light 212 or the indicator light strip can be located in a channel 220 in the inclined platform 120 and the panels 124. Like the indicator light strip, the channel 220 can extend from the rear edge of the inclined platform 120 to the front edge of the inclined platform 120 so that the indicator light strip can be flush.

In some embodiments, a plurality of remote radio (RR) readers 215 can be coupled to the board 110. The RR readers 215 may be individually battery powered, or coupled to the power source 246. In one embodiment, one or more RR readers 215 can be located on a bottom side of each of the pair of panels 124. Alternatively, the RR readers 215 may be affixed to the front surface 146 of the pair of panels 124. The RR readers 215 may be embedded in the bottom side or the front surface 146 of the pair of panels 124. The RR readers 215 may be flush with, or coplanar with, the front surface 146 of the panels 124 The coplanar RR readers 215 may be located beneath a veneer that is affixed to the front surface 146 of the pair of panels 124. For example, each panel in the pair of panels 124 may include one RR reader 215. Alternatively, two or more RR readers 215 can be positioned on each panel 124 to divide the panel into two or more different sections. Each section can be used for scoring or other game play parameters, as described more fully in the proceeding paragraphs.

In some embodiments, one or more of the beanbags 112 can include a remotely interrogatable radio (RIR) sensor 217 attached to or located within the beanbag 112. The RIR sensor 217 can communicate with an RR reader 215. The RIR sensor 217 can receive a signal from an RR reader 215. The RIR sensor 217 can then send a response to the RR reader 215 that includes a unique identification of the RIR sensor 217.

The RIR sensor 217 may be affixed to an exterior portion of the one or more beanbags 112. Alternatively, the RIR sensor 217 may be located inside of the one or more beanbags 112. In another alternative, a first RIR sensor 217 may be affixed to an interior surface of a top of the one or more beanbags 112 and a second RIR sensor may be affixed to an interior surface of a bottom of the one or more beanbags 112. In yet another embodiment, a first RIR sensor 217 may be affixed to an exterior surface of a top of the one or more beanbags 112 and a second RIR sensor may be affixed to an exterior surface of the bottom of the one or more beanbags 112.

In some embodiments, the RIR sensors 217 can be actively powered sensors, with each RIR sensor having its own battery supply. Alternatively, the RIR sensor 217 can be passively or ambiently powered sensors, such as a radio frequency identification tag or an ambient internet of things (IoT) tag. In one example, the ambiently powered RIR sensors can be powered by a radio frequency (RF) signal emitted by the one or more RR readers or a separate RF emitter on the board 110. Alternatively, the ambient powered RIR sensors may be powered by other ambient energy sources, such as the ambient environmental temperature, kinetic energy when the beanbags 112 are thrown, etc.

The RIR sensors 217 can communicate with the one or more RR readers 215 when the RIR sensors are within a predetermined distance of the one or more RR readers 215. The RR readers 215 and the RIR sensors 217 can be configured to have a predetermined communication distance. For example, the communication distance may be 4 inches, 6 inches, 8 inches, 10 inches, 12 inches, 18, inches, 24 inches, or another desired distance. Each RIR sensor 217 can communicate its unique identification number to the RR reader 215 when the RIR sensor 217 is within a communication range of the RR reader 215. The RR reader may then send the unique identification number to the processor 254. The unique identification can be used to determine which beanbag is thrown and to which team the beanbag 112 belongs.

When a beanbag 112 is thrown onto the front surface 146 of the inclined platform 120, an approximate location at which the beanbag 112 comes to rest on the inclined platform 120 can be determined by the processor 254. In one example, the RR reader that is in communication with an RIR sensor(s) 217 associated with the beanbag 112 can send an indication to the processor 254. This indication can be stored in the memory 258 for the length of the game, or another desired period.

The approximate location of the beanbag 112 on the inclined platform 120 can be determined based on which RR reader 215 the RIR sensor 217 is in communication with. Alternatively, when RIR sensor(s) 217 associated with the beanbag 112 are in communication with multiple RR readers 215, the location of the beanbag 112 can be determined based on the RR reader 215 that receives a highest power signal from an RIR sensor 217, thereby indicating a closest distance between RIR sensor associated with the beanbag 112 and the RR reader 215. Using a highest received power level is merely used as one example. The example is not intended to be limiting. The distance of the RIR sensor 217 associated with a beanbag 112 relative to an RR reader 215 can also be determined based on a time delay of a signal sent from the RR reader(s) 215 until a response is received from the RIR sensor 217. In addition, when multiple RIR sensors 217 are associated with a single beanbag 112, the signals from the multiple RIR sensors 217 can be used to determine the location of the associated beanbag on the inclined platform 120 using one or more of a combination of signal power and/or signal timing from the multiple signals communicated by the multiple RIR sensors 217.

The location of the beanbag 112 can be used for scoring. For example, a beanbag 112 landing on the bottom half of the inclined platform 120 can earn 1 point for the team that the beanbag 112 belongs to. A beanbag 112 landing on a top half of the inclined platform 120 can earn 2 points for the team that the beanbag 112 belongs to. In addition, beanbags 112 that are knocked off of the inclined platform 120 may reduce the score of the team that the knocked off beanbag 112 belongs to and/or increase the score of the team that knocked off the beanbag 112.

Scoring and location may also be determined by receiving multiple inputs at the processor 254 from multiple sensors. For example, when a beanbag 112 is thrown onto the inclined platform 120, the following signaling may occur. The platform sensor 208 can send a signal to the processor 254 indicating that a vibration occurred that was caused by the beanbag 112 landing on the board 110. At approximately the same time, the RR reader 215 with the highest received power signal from an RIR sensor 217 can send a signal to the processor 254 indicating the unique identification of the beanbag 112. If the unique identification of the beanbag had not previously been sent to the processor 254 during a game, then the processor can send a signal to increase the score for the team associated with the beanbag and/or light a section of the board 110 based on where the beanbag landed. If the platform sensor 208 sends a signal and at approximately the same time, a unique identification of a beanbag that was previously sent to the processor 254 during the game is no longer read by an RR reader 215, then the processor 254 can adjust the score based on a beanbag being knocked off of the inclined platform 120. Similarly, if an RR reader 215 sends a signal to the processor 254 indicating a unique identification of a beanbag has landed within RR reader's 215 proximity and/or the RR reader 215 has received the highest power signal, then the processor 254 can indicate that the beanbag 112 has landed adjacent to the inclined plane, but not on the inclined plane. The score can be adjusted as desired by the type of game that is played.

Accordingly, using multiple sensor signals received at the processor 254, such as the signals from the RIR sensors 217 and the platform sensor 208, can be used to increase a reliability of score keeping by the processor 254. The timing of the signals may be substantially simultaneously, such as within microseconds when a bean bag lands on a surface and the platform sensor 208 and an RR reader 215 each send a signal to the processor at approximately the same time. However, some signaling may occur over larger time frames, such as when a beanbag may slowly drift off of the inclined platform 120 and onto the ground, which may take multiple seconds. The reliability of the scoring based on the position of the beanbags on the inclined surface, or that are knocked off of the inclined surface, can be increased using the multiple sensors and timing of the signals received at the processor 254.

However, the multiple sensors are not necessary to play the game. For example, certain embodiments of the game may not include the RR readers 215 or RIR sensors 217. In those embodiments, the platform sensor 208 and the aperture sensor 196 can be used to determine a score as gameplay proceeds, as discussed herein.

In some embodiments, the game board 110 can comprise a pair of buttons 224 carried by the inclined platform 120 and one of the panels 124. The pair of buttons 224 can be positioned proximate to the display 192. The pair of buttons 224 can comprise an increase button 224A with an increase indicator and a decrease button 224B with a decrease indicator. The pair of buttons 224 can be used to manually increase and/or decrease the score as displayed on the display 192, as discussed in further detail below. In one aspect, the display 192 can have or can be two displays associated with two players or two teams. The pair of buttons 224 can be a first pair of buttons 224 and can further comprise a second pair of buttons 226 associated with the two players or the two teams. Like the first pair of buttons 224, the second pair of buttons 226 can comprise an increase button 226A with an increase indicator and a decrease button 226B with a decrease indicator. The first pair of buttons 224 can be located on one side of the display 192 and adjacent a display or score associated with the first team, while the second pair of buttons 226 can be located on an opposite side of the display 192 and adjacent a display or score associated with the second team.

In some embodiments, the game board 110 can have a mode selector 230 (FIG. 7) or button carried by the inclined platform 120 and the pair of panels 124 to enable selection of a single board mode and a double board mode with a second cornhole game board. In another aspect, the mode selector 230 can enable selection of at least a remote mode and dual board mode with a second cornhole game board, as described in further detail below.

In some embodiments, the game board 110 and the platform 120 or the panels 124 can have a power (on/off) button 232 to enable powering the game and the processors on and off. In one aspect, the power button 232 can be a lighted button that can illuminate when powered on. In another aspect, the power button 232 can be flush with, or coplanar with, the front surface 146 of the panels 124 and the inclined platform 120 so as to resist interference with game play.

In some embodiments, the game board 110 can have a foot step button 234 (FIG. 6) carried by the distal spar 168 of the rear leg 164, as discussed in further detail below. The foot step button 234 can thus be positioned adjacent the support surface to be engage by a foot of a user standing proximate to the game board 110.

In some embodiments, the game board 110 can have a graphic carried by the inclined platform 120 and the front surface 146 of the panels 124. In one aspect, the graphic and/or the inclined platform 120 and the front surface 146 of the panels 124 can be smooth to facilitate sliding of the beanbags 112 on thereon.

In some embodiments, the game board 110 can have a hole light 238 (FIG. 7) positioned proximate to the aperture 188. In one aspect, the hole light can be a circular light strip circumscribing a perimeter of the aperture 188.

In some embodiments, the game board 110 can have an audio speaker 242 (FIG. 7) carried by the inclined platform 120 or one of the panels 124 to emit audible instructions and/or celebratory sounds. In some embodiments, the game board 110 can also have volume control buttons, such as a volume up button and a volume down button.

The game board 110 can also have a power source 246. In one aspect, the power source 246 can be carried by the game board 110 and can comprise batteries. In another aspect, the power source can be external to the game board. The power source can power the game electronics 250 (FIG. 8).

Figure 8:
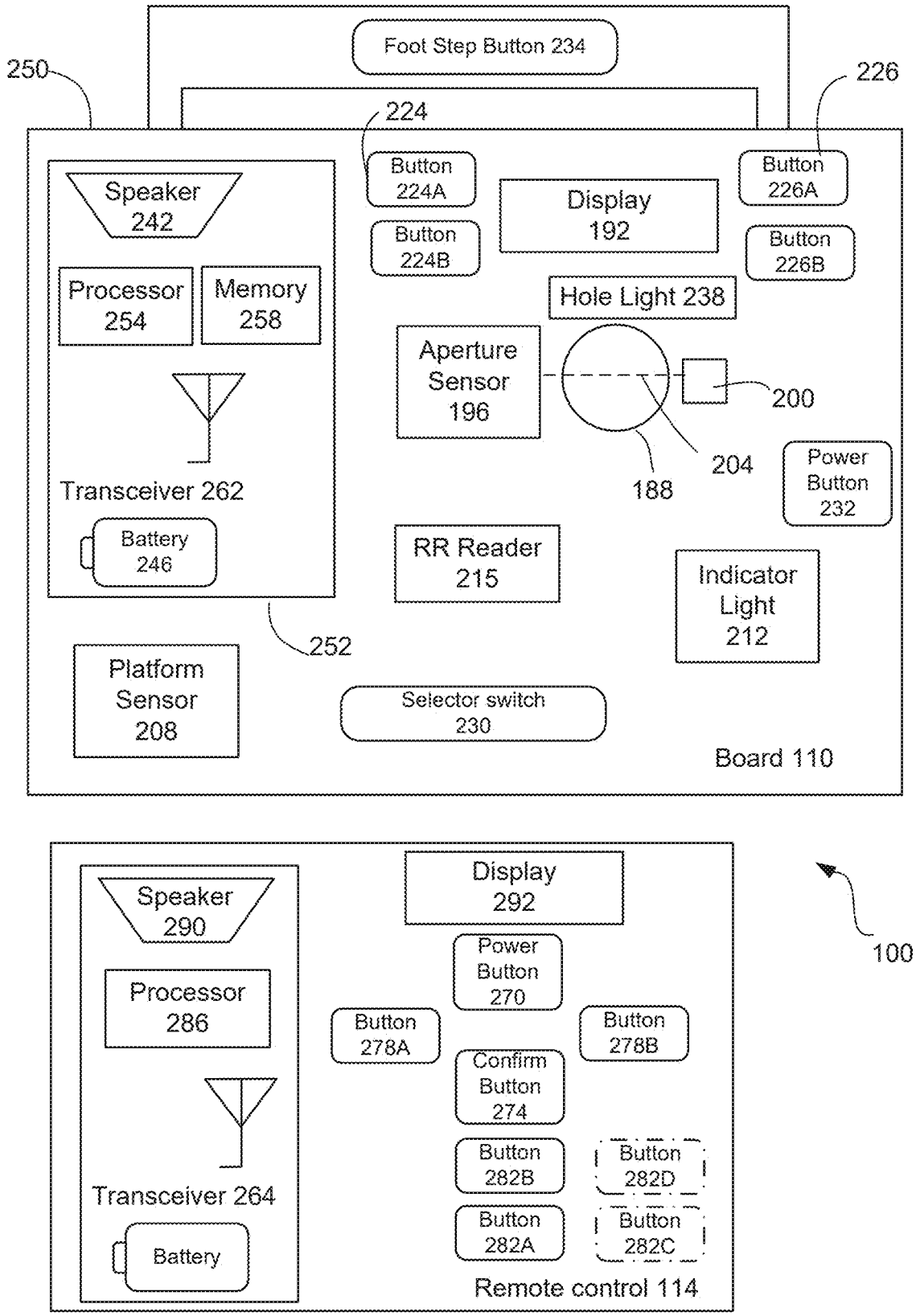
FIG. 8 is an example schematic diagram of the cornhole game system of FIG. 1, according to some embodiments.

Referring to FIG. 8, the game electronics 250 can be carried within the game board 110 or under the game board 110, such as within or under the inclined platform 120, and within or under one or both panels 124. The game electronics 250 can be located in a single area, such as on a printed circuit board (PCB) mounted to the inclined platform 120 or the panels 124. Alternatively, the game electronics may be distributed throughout the game board 110, the inclined platform 120 and the panels 124. The game electronics 250 can include a controller 252, such as one or more base processors 254, electrically coupled to the sensors, the buttons, the lights and the power source.

The controller 252 can be comprised of one or more digital processors 254 and memory 258. The memory 258 can be coupled to the one or more digital processors 254. The one or more digital processors 254 can be general purpose processors, specialized processors such as very large scale integrated (VLSI) circuits, field programmable gate array processors (FPGAs), or other types of specialized processors, as well as baseband processors used in transceivers to send, receive, and process wireless communications. The controller 252 can comprise a single chip, or multiple chips in a single package, that provides the different processing and transceiver operations described herein. The terms "controller", "processor", "processors", and "one or more processors" is used interchangeably herein. The controller 252 can have one or more "base" processors 254 (while the remote control can have one or more "remote" processors, as discussed below).

In some embodiments, the controller 252 or the base processors 254 can be electrically coupled to the display 192, the aperture sensor 196, the platform sensor 208 and the indicator light 212. The controller 252 can be configured to send a signal to the indicator light 212 to enable an indication of the team turn. The controller 252 can be configured to receive a signal from the aperture sensor 196 indicating a hole score for the team turn. The controller 252 can be configured to receive a signal from the platform sensor 208 indicating a board score for the team. The controller 252 can be configured to determine a team score based on signals from the aperture sensor 196 and the platform sensor 208 and the team turn. For example, a beanbag 112 landing on the game board 110 or the inclined platform 120 can earn 1 point, while a beanbag 112 passing through the aperture 188 can score 3 points. If a beanbag 112 initially lands on the inclined platform 120 and is then subsequently pushed through the aperture 188 by another beanbag 112 in the same round, it can score 3 points rather than 4 points. The controller 252 can be configured to send a signal to the display 192 to enable display of the team score.

In some embodiments, the controller 252 can be configured to determine a first team score based on signals from the aperture sensor 196 and the platform sensor 208 and a first team turn. The controller 252 can be configured to determine a second team score based on signals from the aperture sensor 196 and the platform sensor 208 and a second team turn. The controller 252 can be configured to determine a round team score by subtracting a lower of the first and second team score from a higher of the first and second team score. The controller 252 can be configured to determine a running score by adding the round team score to a corresponding running team score. For example, with respect to cancellation scoring, the lower score is canceled out in the current round, but the controller 252 can retain the scores from previous rounds. For example, if the previous round's total was Blue 5 and Red 7, and in the current round Blue scores 5 and Red scores 3, the controller 252 can calculate 5−3=2 points for Blue. Adding these 2 points to the previous scores, both teams now have 7 points each. The controller 252 can be configured to send a signal to the display 192 to enable the display of the running team score. In two-board mode, the active game board can display the score for the current round, while the inactive game board can display the total score, excluding the current round's score.

In some embodiments, the controller 252 can be electrically coupled to the pair of buttons 224 (and 226). The controller 252 can be configured to add a point to the team score displayed on the display 192 based on a signal from the increase button 224A (or 224B) and/or subtract a point from the team score displayed on the display 192 based on a signal from the decrease button 224B (or 224B).

In some embodiments, the memory 258 can be coupled to the controller 252 or the one or more base processors 254 to enable storing multiple rounds of scores.

In some embodiments, the game board 110 and the controller 252 can further comprise a transceiver 262, or base transceiver, coupled to the base processors 254 to enable wireless pairing and communication with another transceiver of another cornhole game board (which can be substantially identical the cornhole game board 110 described herein). The transceiver 262 can be configured to transmit one or more of: the team score, the team turn, the hole score, the board score, or the running score. In addition, the transceiver 262 can be configured to receive one or more of: a team score, the team turn, the hole score, the board score, or the running score.

In some embodiments, the controller 252 can be further coupled to the foot step button 234. The controller 252 can be further configured to receive a signal from the foot step button 234 to enable one or more of: game selection confirmation and game start, enter or exit sleep mode, initiate pairing with a remote control or a second cornhole game board, or change teams.

In some embodiments, the controller 252 can be further coupled to the hole light 238. The controller 252 can be further configured to send signals to the hole light 238 and the indicator light 212 to enable the hole light 238 and the indicator light 212 to emit light when powered on, in response to a winner, and in response to a score (e.g. a beanbag 112 landing on the inclined platform 120 or going through the aperture 188). In addition, the indicator light 212 and the hole light 238 can emit light when a beanbag passes through the aperture.

In some embodiments, the controller 252 can be further coupled to the speaker 242. The controller 252 can be further configured to send signals to the speaker 242 to enable the speaker 242 to emit one or more of to emit one or more of: an audible instruction, a celebratory sound associated with scoring, or an audible score (e.g. in response to a button being pressed).

In some embodiment, the controller 252 and the one or more base processors 254 can be coupled to the base transceiver 262 to enable wireless pairing and communication with a remote transceiver 264 of a remote control 114. According to some embodiments, the remote control 114 can comprise and can carry a power button 270; a confirm ("enter") button 274; at least one game select button 278 (e.g. a decrease "<" button 278A and an increase ">" button 278B) and/or a score adjust button 278 (e.g. a blue team score decrease button 278A and an blue team score increase button 278B; and a pair of score adjust buttons 282, including a red team score increase button 282B and a red team score decrease button 282A. The button 274 can also be a change round button to switch between red and blue teams. The buttons 278A and 278B can also be pressed simultaneously to return to game selection. In addition, the remote control 114 can comprise one or more remote processors 286 coupled to the power button 270, the confirm button 274, the at least one game select button 278, the pair of score adjust buttons 282, and the remote transceiver 264. The remote processors 286 can be configured to send signals to the base transceiver 262 of the cornhole game board 110 to enable: game selection in response to activation of the at least one game select button 278 (or 278A and 278B) and the confirm button 274; increase the team score displayed on the display 192 in response to activation of the score increase button 282B; and decrease the total team score displayed on the display 192 in response to activation of the score decrease button 282A. The remote control 114 can further comprise a speaker 290 carried by the remote control 114 and coupled to the one or more remote processors 286 to enable the speaker to emit one or more of: an audible instruction, a celebratory sound associated with scoring, or an audible score.

According to some embodiments, the remote control 114 can comprise a power button 270, a confirm or enter button 274, a score(S) button 278B, and a menu (M) button 278A. The power button 270 can power the game on and off. For example, pressing the power button 270 once can enable sleep mode, and pressing and holding the power button 270 can turn the game off. The enter button 274 can select and also can be pressed to start a new round. The menu button 278A can be pressed for game selection and repeatedly pressed to scroll through games. The score button 278B can be pressed to enable the speaker 290 of the remote control 114 or the speaker of the board to announce the total or running score for both teams. The remote control 114 can also comprise a red team score decrease button 282A, a read team score increase button 282B, a blue team score decrease button 282C and a blue team score increase button 282D. In the menu mode, the decrease and increase buttons, e.g. 282C and 282D, can also be used to scroll through the menu. The decrease and increase buttons, e.g. 282A and 282B can also be used to control the volume on the remote control and the board.

In addition, the remote control 114 can also enable a user to return to the main menu and select a new game, even if currently in the middle of playing a game, by pressing a specific sequence of buttons on the remote control.

In addition, the remote processors 286 can be configured to enable the speaker 290 to announce the total score.

In addition, the remote control 114 can also have a remote display 292 that can display the total score. For example, the display can be a liquid crystal display (LCD) screen. The remote processors 286 can be electrically coupled to the remote display 292.

In addition, the remote control 114 can also have volume control buttons, such as a volume up button and a volume down button.

Cornhole Game System and Cornhole Game Board In Use

Referring to FIG. 5, the cornhole game board 110 can be setup by sliding the one or more slide locks 132, or finger tabs 142 thereof, to release the hooks 134 from the inner edge of the lock hole 136, and release the pair of panels 124 from one another. The pair of panels 124 can be unfolded from the closed storage orientation to the open play orientation. The rear leg 164 can be pivoted from the retracted position to the extended position. The U-shaped member 172 (positioned as a handle in the handle position) can be removed from the pair of panels 124 and positioned in the leg position at the intermediate location of the panels 124 (as a leg). The panels 124 can be positioned on the support surface to form the inclined platform 120.

The game board 110 and the inclined platform 120 can be powered on and paired with the remote control 114 (remote mode) or paired with another game board (dual board mode).

Figure 7:
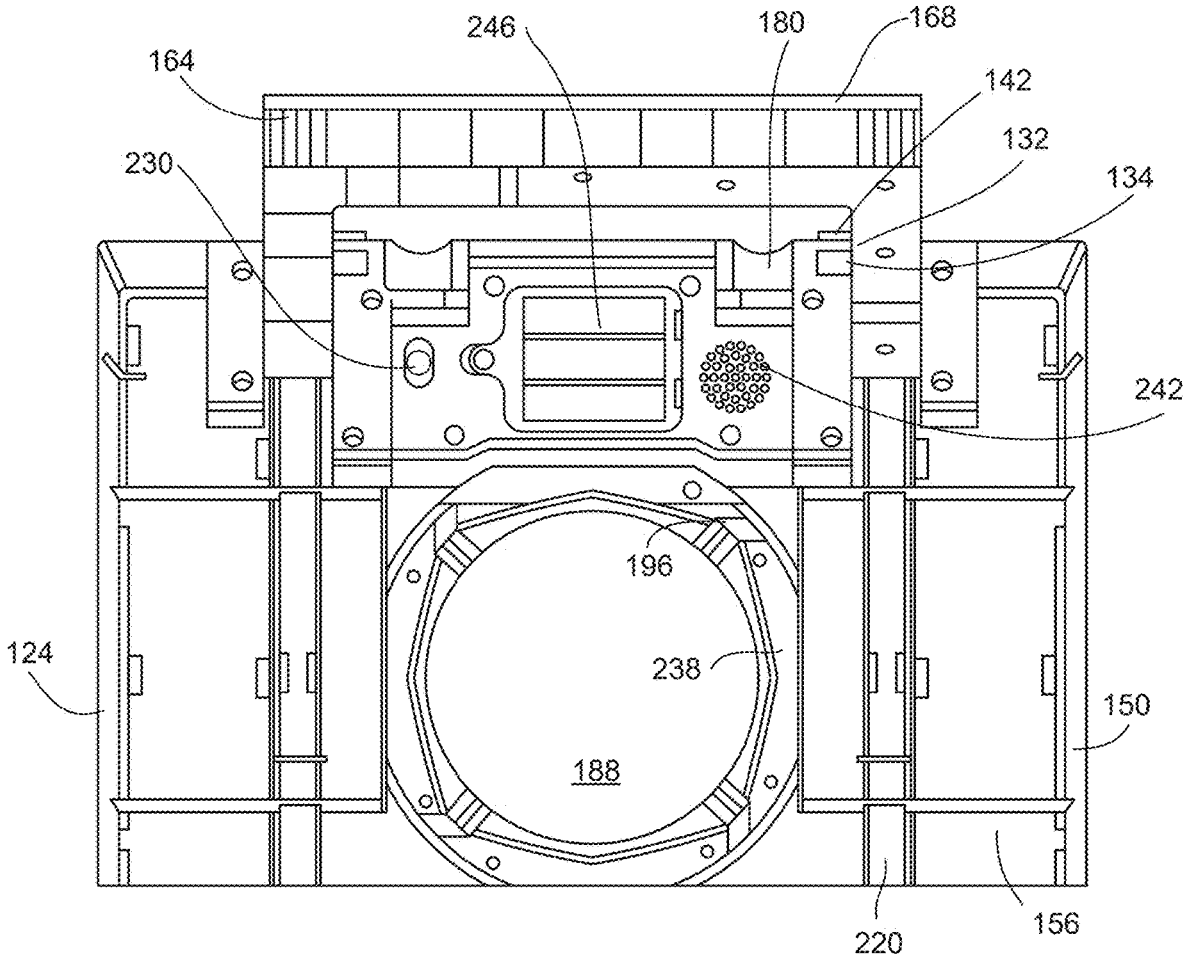
FIG. 7 is a partial bottom view of the cornhole game board of FIG. 2.
Figure 9:
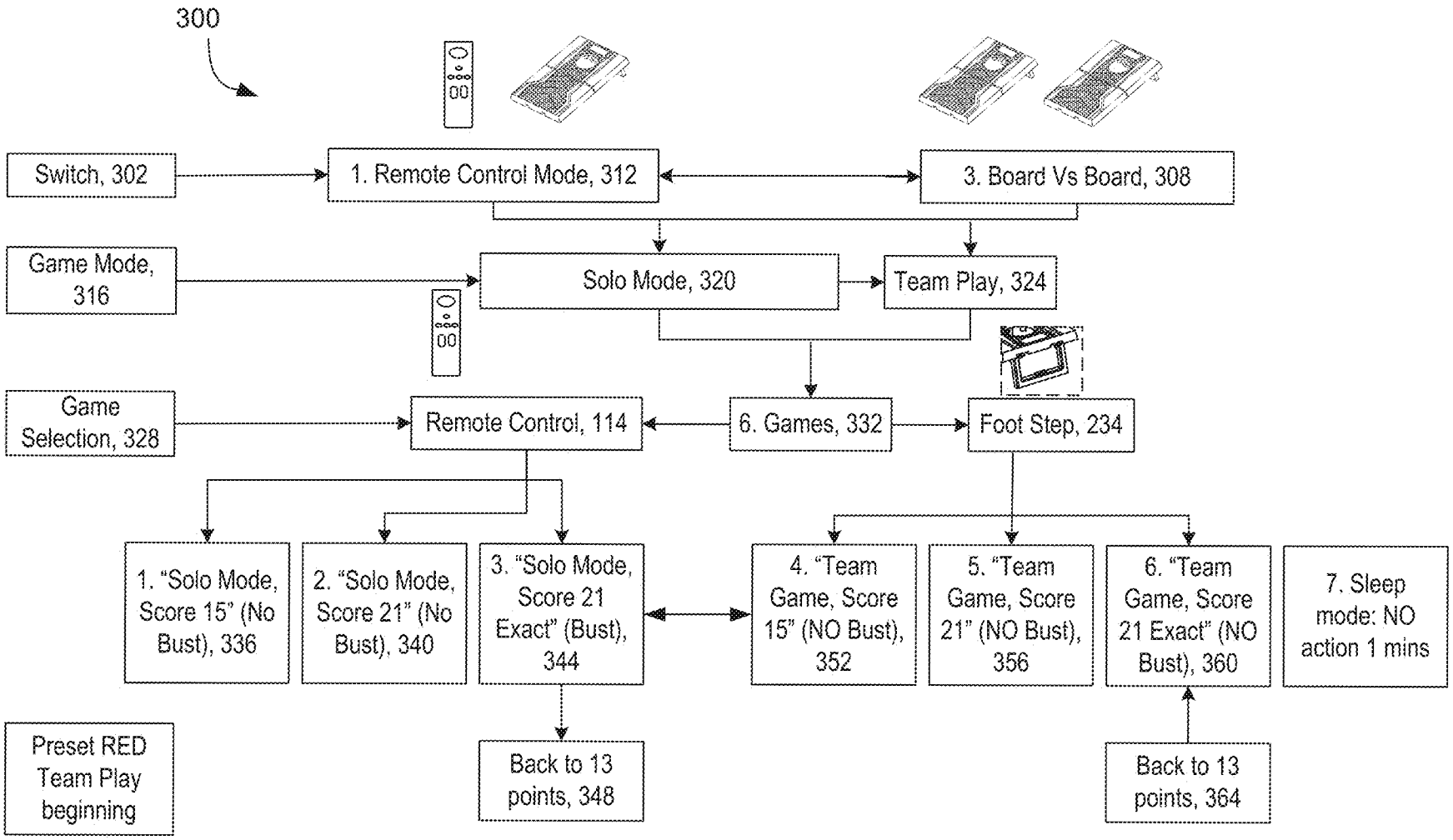
FIG. 9 is a flow chart of an example set-up of the cornhole game system of FIG. 1, according to some embodiments.

Referring to FIGS. 7-9, for dual board mode, the mode selector 230 can select 300 the dual board mode and can be switched from the a single board mode 312, or single board with remote mode, to the dual board mode or position 308 (for both boards). The controllers 252 of both game boards 110 can be configured to pair with one another.

The game boards 110 and the controllers 252 (or processors 254) can have a sleep mode. For example, when the game boards 110 remain inactive for a predetermined time (e.g. three minutes), the controllers 252 can automatically enter the sleep mode. To wake the game boards 110 and the controllers 252 (processors 254), the foot step button 234 ("enter" button) can be can be pressed; after which the game boards 110 and the controllers 252 can resume the previous game. As another example, when the game boards 110 remain inactive for a predetermined extended time (e.g. are left unattended for fifteen minutes), the controllers 252 can automatically power off (power off mode). To restart, the power (on/off) button 232 can be pressed. In addition, to preserve battery life, the game boards 110 and the controllers 252 can manually enter sleep mode by stepping on the foot step button 234 ("enter") and holding for a predetermined time (e.g. two seconds).

Referring to FIG. 9, a flow chart of an example set-up 300 of the cornhole game system 100 is shown, according to some embodiments. To select a mode, with a single game board or with dual game boards, the mode selector 230 can select 302 or can be switched to the desired mode. In addition, the power (on/off) button 232 of the board, or the power (on/off) button 270 of the remote control 114, can be pressed and held for a predetermined time (e.g. two seconds) or until the controller (or remote processors 286) of the remote control 114 cause the speaker 290 to emit a "pairing" message.

The game board(s) 110 and the remote control 114 can have a sleep mode. When the game board and the remote control remain inactive for a predetermined time (e.g. three minutes), the game board and/or the remote control (and controllers and processors thereof) can automatically enter sleep mode. Any button on the remote can be pressed to wake the game board; after which the board(s) and the controller(s) can resume the previous game. When the game board(s) and the remote control remain inactive for a predetermined time (e.g. are left unattended for fifteen minutes), the controllers can automatically power off. To restart, the mode selector can be switched to the power off mode and back to the remote mode. In addition, to preserve battery life, the remote can be used to manually activate sleep mode by pressing the power (on/off) button on the remote control for a predetermined time (e.g. for two seconds).

The game board 110 and controller 252 (or base processors 254) can enter 316 a game mode, such as a solo mode 320 and a team mode 324.

Games 332 can be selected 328 in either the remote mode with the remote control 114 or the dual board mode with the game board 110. In remote mode 312, the game selector button(s) 278A and 278B ("<" and/or ">") on the remote control 114 can be pressed to browse through a plurality of games 332, as described further below. The confirm ("enter") button 274 on the remote control 114 can be pressed to begin the selected game. In dual board mode 308, the game selector button(s) 278A and 278B ("<" and/or ">") on the remote control 114, or the buttons 224A and 224B (and 226A and 226B) on the game board 110, can be pressed to browse through a plurality of games 332. The confirm ("enter") button 274 on the remote control 114, or the foot step button 234 of the game board 110, can be pressed to begin the selected game.

To return to a main menu during game play, the game selector button(s) 278A and 278B on the remote control 114, or the buttons 224A and 224B (and 226A and 226B) on the game board 110, can be pressed (e.g. both game selector buttons on the remote control, or both buttons on the game board, at the same time or simultaneously).

The game board 110 can have different game modes, such as solo mode 320 and team mode 324. Each mode can have different games 332 with different game scoring. In solo mode 320 (for single players), the games can include 15 Points (e.g. reach 15 points to win) 336; 21 Points Non-Exact (e.g. reach or exceed 21 points to win) 340; and 21 Points Exact 344 (e.g. score exactly 21 points to win, but if exceed 21 points, score reverts 348 to 13). In team mode 324 (two or more players), the games can include 15 Points (e.g. reach 15 points to win) 352; 21 Points Non-Exact (e.g. reach or exceed 21 points to win) 356; and 21 Points Exact 360 (e.g. score exactly 21 points to win, but if exceed 21 points, score reverts 364 to 13). Thus, the plurality of games can comprise: a '15 Points' game where reaching 15 points wins; a '21 Points Non-Exact' game where reaching or exceeding 21 points wins; and a '21 Points Exact' game where scoring exactly 21 points wins, but exceeding 21 points reverts the score to 13.

To begin play, the controller 252 (or the base processors 254) can cause the game board lights (e.g. the indicator light 212 and/or the hole light 238) to light in multiple colors to indicate that the game has begun. Next Turn-after each toss, the confirm ("enter") button 274 on the remote control 114 can be pressed to proceed to the next turn. Start A New Round-after each round, the confirm ("enter") button 274 on the remote control 114 can be pressed to initiate the next round. Score Adjustments—the buttons 224A and 224B (and 226A and 226B) on the game board 110 can be pressed to manually add or subtract points. For example, the red increase and decrease buttons 224A and 224B can be pressed to manually add or subtract points for the red team; and the blue increase and decrease buttons 226A and 226B can be pressed to manually add or subtract points for the blue team. Checking the Score—the confirm ("enter") button 274 on the remote control 114 can be pressed and held to hear the current score during gameplay. In addition, a player can place their hand in the aperture 188 to hear the score.

The cornhole game rules can comprise dividing into teams (e.g. red and blue teams) and allocating the beanbags 112 (e.g. each team gets 4 beanbags in their team color). The game rules can comprise positioning the game board 110. For a single board the players can be positioned 10-27 feet from the front edge of the game board; adjusting the distance based on the player skill level. For dual boards, the two game boards can face each other spaced-apart a distance between the front edges of the boards to approximately 10-27 feet.

An objective of the game can be the first team to reach 15, 21, or exactly 21 points depending on the selected game mode). For rounds, the players alternate turns, with each team throwing all 4 beanbags per round. For example, the red team can toss a beanbag, then press the confirm ("enter") button 274 on the remote control to end their turn. The blue team can then toss a beanbag and press the confirm ("enter") button 274 to switch turns back to the red team, and so on until all 4 beanbags are thrown.

After all bags are thrown, the game board can calculate the total score for the round using cancellation scoring. The team with the higher score can toss first in the next round, as indicated by the indicator light. This continues until a team reaches the winning score for the selected game mode (e.g., 15, 21, or 21 exact points).

For scoring, a beanbag 112 on the game board 110 can be awarded one point while a beanbag 112 through the aperture 188 can be awarded three points. For cancellation scoring, the game board 110 can subtract the lower score from the higher score for each round. For example, if the red team scores 5 points and blue team scores 3 points, the red team will receive 2 points for that round. Only one team scores at each round. Winning can be determined by the first team to reach 15 or 21 points wins (depending on which game is selected). In 21 Exact, the team must reach 21 points exactly, exceeding 21 points will cause the score to revert to 13 points.

Figure 10:
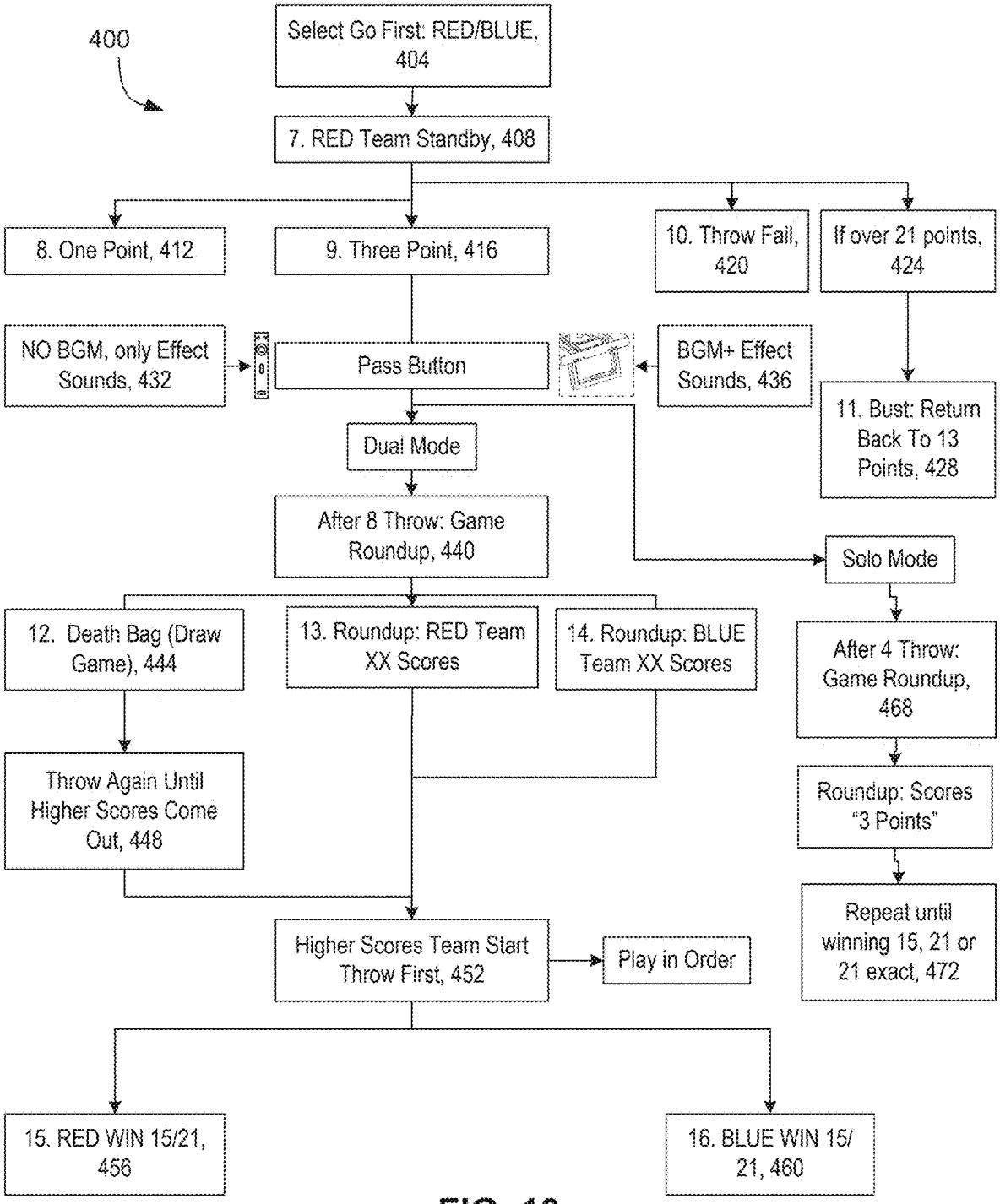
FIG. 10 is a flow chart of an example game play and scoring of the cornhole game system of FIG. 1, according to some embodiments.

Referring to FIG. 10, an example method and configuration 400 of the controller 252 and the processors 254 is shown, according to some embodiments. The controller 252 can select 404 a player or a team to go first and can signal the indicator light 212 to emit or indicate 408 the associated color, e.g. red. The controller 252 can add one point 412 for a board score (i.e. when the platform sensor 208 is activated by a beanbag 112 striking the inclined platform 120); three points 416 for a hole score (i.e. when the aperture sensor 196 is activated by a beanbag 112 passing through the aperture 188); and/or a throw fail 420 if a beanbag 112 fails to score. The controller 252 can determine 424 if the score equals 21 or if the total score exceeds 21 resulting in a bust 428 and adjusting the score to 13. The controller 252 can sense when a round is complete from the confirm or pass ("enter") button 274 on the remote control 114 being pressed 432, or the foot step button 234 of the game board 110 being pressed 436. During play, the controller can play background music (BGM) through the speaker 242 of the game board 110 or the speaker 290 of the remote control 114. The controller 252 can determine 440 a final score from the round by subtracting a lower score from one team from a higher score of the other team. In case of a draw 444 (i.e. a tie), the teams may throw again 448 for a higher score. Otherwise, the higher score team throws first 452 for the next round. The controller 252 can signal the indicator light 212 to emit or indicate a first team (e.g. red) win or turn 456 or a second team (e.g. blue) win or turn 460.

According to some embodiments, in solo mode, the controller 252 can determine 468 a score after a round of a predetermined number of throws, e.g. four throws. The rounds can be repeated 472 until winning.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

Various techniques, or certain aspects or portions thereof, can take the form of program code (i.e., instructions) embodied in tangible media, such as floppy diskettes, compact disc-read-only memory (CD-ROMs), hard drives, non-transitory computer readable storage medium, or any other machine-readable storage medium wherein, when the program code is loaded into and executed by a machine, such as a computer, the machine becomes an apparatus for practicing the various techniques. Circuitry can include hardware, firmware, program code, executable code, computer instructions, and/or software. A non-transitory computer readable storage medium can be a computer readable storage medium that does not include signal. In the case of program code execution on programmable computers, the computing device can include a processor, a storage medium readable by the processor (including volatile and non-volatile memory and/or storage elements), at least one input device, and at least one output device. The volatile and non-volatile memory and/or storage elements can be a random-access memory (RAM), erasable programmable read only memory (EPROM), flash drive, optical drive, magnetic hard drive, solid state drive, or other medium for storing electronic data. One or more programs that can implement or utilize the various techniques described herein can use an application programming interface (API), reusable controls, and the like. Such programs can be implemented in a high level procedural or object oriented programming language to communicate with a computer system. However, the program(s) can be implemented in assembly or machine language, if desired. In any case, the language can be a compiled or interpreted language, and combined with hardware implementations.

As used herein, the term processor can include general purpose processors, specialized processors such as VLSI, FPGAs, or other types of specialized processors, as well as baseband processors used in transceivers to send, receive, and process wireless communications.

It should be understood that many of the functional units described in this specification have been labeled as modules, in order to more particularly emphasize their implementation independence. For example, a module can be implemented as a hardware circuit comprising custom very-large-scale integration (VLSI) circuits or gate arrays, off-the-shelf semiconductors such as logic chips, transistors, or other discrete components. A module can also be implemented in programmable hardware devices such as field programmable gate arrays, programmable array logic, programmable logic devices or the like.

In one example, multiple hardware circuits or multiple processors can be used to implement the functional units described in this specification. For example, a first hardware circuit or a first processor can be used to perform processing operations and a second hardware circuit or a second processor (e.g., a transceiver or a baseband processor) can be used to communicate with other entities. The first hardware circuit and the second hardware circuit can be incorporated into a single hardware circuit, or alternatively, the first hardware circuit and the second hardware circuit can be separate hardware circuits.

Modules can also be implemented in software for execution by various types of processors. An identified module of executable code can, for instance, comprise one or more physical or logical blocks of computer instructions, which can, for instance, be organized as an object, procedure, or function. Nevertheless, the executables of an identified module need not be physically located together, but can comprise disparate instructions stored in different locations which, when joined logically together, comprise the module and achieve the stated purpose for the module.

Indeed, a module of executable code can be a single instruction, or many instructions, and can even be distributed over several different code segments, among different programs, and across several memory devices. Similarly, operational data can be identified and illustrated herein within modules, and can be embodied in any suitable form and organized within any suitable type of data structure. The operational data can be collected as a single data set, or can be distributed over different locations including over different storage devices, and can exist, at least partially, merely as electronic signals on a system or network. The modules can be passive or active, including agents operable to perform desired functions.

Reference throughout this specification to "an example" or "exemplary" means that a particular feature, structure, or characteristic described in connection with the example is included in at least one embodiment of the present invention. Thus, appearances of the phrases "in an example" or the word "exemplary" in various places throughout this specification are not necessarily all referring to the same embodiment.

As used herein, a plurality of items, structural elements, compositional elements, and/or materials can be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention can be referred to herein along with alternatives for the various components thereof. It is understood that such embodiments, examples, and alternatives are not to be construed as defacto equivalents of one another, but are to be considered as separate and autonomous representations of the present invention.

Furthermore, the described features, structures, or characteristics can be combined in any suitable manner in one or more embodiments. In the following description, numerous specific details are provided, such as examples of layouts, distances, network examples, etc., to provide a thorough understanding of embodiments of the invention. One skilled in the relevant art will recognize, however, that the invention can be practiced without one or more of the specific details, or with other methods, components, layouts, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A cornhole game board, comprising:

a platform configured to receive a beanbag thereon;

an aperture in the platform configured to receive the beanbag therethrough;

a display carried by the platform and configured to display at least one score;

an aperture sensor positioned proximate to the aperture and configured to sense a beanbag passing through the aperture;

a platform sensor coupled to the platform and configured to sense the beanbag impacting the platform;

an indicator light carried by the platform and configured to indicate a team turn; and one or more processors electrically coupled to the display, the aperture sensor, the platform sensor and the indicator light, the one or more processors configured to:

send a signal to the indicator light to enable an indication of the team turn;

receive a signal from the aperture sensor indicating a hole score for the team turn;

receive a signal from the platform sensor indicating a board score for the team turn;

determine a team score based on signals from the aperture sensor and the platform sensor and the team turn; and send a signal to the display to enable display of the team score.

2. The cornhole game board of claim 1, further comprising:

a pair of buttons carried by the platform and positioned proximate the display;

the pair of buttons comprising an increase button with an increase indicator and a decrease button with a decrease indicator; and the one or more processors electrically coupled to the pair of buttons and further configured to:

add a point to the team score displayed on the display based on a signal from the increase button and/or subtract a point from the team score displayed on the display based on a signal from the decrease button.

3. The cornhole game board of claim 2, wherein the one or more processors are further configured to:

receive a signal from the increase button and/or the decrease button to enable browsing through a plurality of games.

4. The cornhole game board of claim 3, wherein the one or more processors are further configured to:

receive a signal from an enter button to enable game selection confirmation.

5. The cornhole game board of claim 3, further comprising:

a rear leg coupled to the platform and having a distal spar configured to abut to a support surface;

a foot step button carried by the distal spar; and the one or more processors further coupled to the foot step button and further configured to:

receive a signal from the foot step button to enable game selection confirmation.

6. The cornhole game board of claim 3, wherein the plurality of games comprises:

a '15 Points' game where reaching 15 points wins;

a '21 Points Non-Exact' game where reaching or exceeding 21 points wins; and a '21 Points Exact' game where scoring exactly 21 points wins, but exceeding 21 points reverts the score to 13.

7. The cornhole game board of claim 2, wherein the one or more processors are further configured to:

receive a signal from the increase button and the decrease button simultaneously to enable returning to a main menu.

8. The cornhole game board of claim 2, further comprising:

the display, the indicator light, and the pair of buttons being flush with a front surface of the platform.

9. The cornhole game board of claim 1, further comprising:

a transceiver coupled to the one or more processors to enable wireless pairing and communication with a second transceiver of a second cornhole game board; and wherein the transceiver is configured to transmit one or more of: the team score, the team turn, the hole score, the board score, or a running score;

wherein the transceiver is configured to receive one or more of: the team score, the team turn, the hole score, the board score, or the running score.

10. The cornhole game board of claim 9, further comprising:

a mode selector carried by the platform and coupled to the one or more processors to enable selection of at least: a single board mode and a dual board mode with the second cornhole game board.

11. The cornhole game board of claim 1, further comprising:

the indicator light being configured to alternately indicate one of two team turns;

the one or more processors further configured to:

determine a first team score based on signals from the aperture sensor and the platform sensor and a first team turn;

determine a second team score based on signals from the aperture sensor and the platform sensor and a second team turn;

determine a round team score by subtracting a lower of the first and second team score from a higher of the first and second team score;

determine a running score by adding the round team score to a corresponding running team score; and send a signal to the display to enable the display of the running team score.

12. The cornhole game board of claim 1, further comprising:

the indicator light being configured to indicate one of two team turns;

the indicator light configured to emit two different colors including a first color corresponding to a first team and a second color corresponding to a second team; and two sets of beanbags including a first set of beanbags with the first color corresponding to the first team and a second set of beanbags with the second color corresponding to the second team.

13. The cornhole game board of claim 1, further comprising:

the platform comprising a pair of panels pivotally coupled together at a hinge and folding about the hinge between:

an open play orientation with the pair of panels folded apart from one another to form the platform; and a closed storage orientation with the pair of panels folded together.

14. The cornhole game board of claim 13, further comprising:

the indicator light comprising an indicator light strip extending across the platform and comprising a first segment carried by a first panel of the pair of panels and a second segment electrically coupled to the first segment and carried by a second panel of the pair of panels.

15. The cornhole game board of claim 13, further comprising:

a U-shaped member selectively coupled to the pair of panels in two different positions, including:

a handle position extending from the pair of panels in the closed storage orientation to enable carrying the pair of panels by the U-shaped member; and a leg position extending from an intermediate location of the platform in the open play orientation to enable support of the intermediate location of the platform by the U-shaped member.

16. The cornhole game board of claim 1, further comprising:

a rear leg having a distal spar configured to abut to a support surface;

a foot step button carried by the distal spar; and the one or more processors further coupled to the foot step button and further configured to:

receive a signal from the foot step button to enable one or more of:

game selection confirmation and game start, enter or exit sleep mode, initiate pairing with a remote control or a second cornhole game board, or change teams.

17. The cornhole game board of claim 1, further comprising:

a hole light positioned proximate to the aperture;

the one or more processors further coupled to the hole light and further configured to:

send signals to the hole light and the indicator light to enable the hole light and the indicator light to emit light when powered on, in response to a winner, or in response to a score.

18. The cornhole game board of claim 1, further comprising:

a speaker carried by the platform; and the one or more processors further coupled to the speaker to enable the speaker to emit one or more of:

an audible instruction, a celebratory sound associated with scoring, or an audible score.

19. A cornhole game board, comprising:

an platform;

an aperture in the platform;

a display carried by the platform and configured to display at least one score;

an aperture sensor positioned proximate to the aperture and configured to sense a beanbag passing through the aperture;

a platform sensor coupled to the platform and configured to sense a beanbag impacting the platform;

an indicator light carried by the platform and configured to indicate a team turn;

a pair of buttons carried by the platform and positioned proximate the display;

the pair of buttons comprising an increase button with an increase indicator and a decrease button with a decrease indicator; and one or more base processors electrically coupled to the display, the aperture sensor, the platform sensor, the indicator light, the increase button and the decrease button, the one or more processors configured to:

send a signal to the indicator light to enable an indication of the team turn;

receive a signal from the aperture sensor indicating a hole score for the team turn;

receive a signal from the platform sensor indicating a board score for the team turn;

determine a team score based on signals from the aperture sensor and the platform sensor and the team turn;

send a signal to the display to enable display of the team score; and add a point to the team score displayed on the display based on a signal from the increase button and/or subtract a point from the team score displayed on the display based on a signal from the decrease button.

20. A cornhole game board, comprising:

a pair of panels pivotally coupled together at a hinge and folding about the hinge between:

an open play orientation with the pair of panels folded apart from one another to form an inclined platform; and a closed storage orientation with the pair of panels folded together;

a rear leg pivotally coupled to one of the pair of panels;

the rear leg having a distal spar configured to abut to a support surface when the rear leg is in an extended position;

a foot step button carried by the distal spar;

an aperture in one of the pair of panels;

a display carried by one of the pair of panels and configured to display at least one score;

an aperture sensor positioned proximate to the aperture and configured to sense a beanbag passing through the aperture;

a platform sensor coupled to one of the pair of panels and configured to sense a beanbag impacting the inclined platform;

an indicator light carried by one of the pair of panels configured to indicate a team turn;

a pair of buttons carried by one of the panels and positioned proximate the display;

the pair of buttons comprising an increase button with an increase indicator and a decrease button with a decrease indicator;

one or more base processors electrically coupled to the display, the aperture sensor, the platform sensor, the indicator light, the pair of buttons and the foot step button, the one or more processors configured to:

send a signal to the indicator light to enable an indication of the team turn;

receive a signal from the aperture sensor indicating a hole score for the team turn;

receive a signal from the platform sensor indicating a board score for the team turn;

determine a team score based on signals from the aperture sensor and the platform sensor and the team turn;

send a signal to the display to enable display of the team score;

add a point to the team score displayed on the display based on a signal from the increase button and/or subtract a point from the team score displayed on the display based on a signal from the decrease button; and receive a signal from the foot step button to enable one or more of:

game selection confirmation and game start, enter or exit sleep mode, initiate pairing with a remote control or a second cornhole game board, or change teams; and a transceiver coupled to the one or more base processors to enable wireless pairing and communication with another transceiver of a second cornhole game board;

wherein the transceiver is configured to transmit one or more of: the team score, the team turn, the hole score, or the board score;

wherein the transceiver is configured to receive one or more of: a team score, the team turn, the hole score, or the board score.

* * * * *